US008596343B2

(12) United States Patent
Christensen et al.

(10) Patent No.: US 8,596,343 B2
(45) Date of Patent: Dec. 3, 2013

(54) PLATE HEAT EXCHANGER

(75) Inventors: Rolf Christensen, Veberöd (SE); Fredrik Andreasson, Södra Sandby (SE); Rolf Bermhult, Lund (SE); Håkan Larsson, Kävlinge (SE); Magnus Svensson, Marieholm (SE)

(73) Assignee: Alfa Laval Corporate AB, Lund (SE)

( * ) Notice: Subject to any disclaimer, the term of this patent is extended or adjusted under 35 U.S.C. 154(b) by 528 days.

(21) Appl. No.: 12/933,717

(22) PCT Filed: Apr. 4, 2008

(86) PCT No.: PCT/SE2008/050396

§ 371 (c)(1),
(2), (4) Date: Oct. 21, 2010

(87) PCT Pub. No.: WO2009/123516

PCT Pub. Date: Oct. 8, 2009

(65) Prior Publication Data

US 2011/0036547 A1 Feb. 17, 2011

(51) Int. Cl.
*F28F 3/08* (2006.01)

(52) U.S. Cl.
USPC ..... 165/165; 165/906

(58) Field of Classification Search
USPC ..... 165/167, 906, 178
See application file for complete search history.

(56) References Cited

U.S. PATENT DOCUMENTS

| | | | | |
|---|---|---|---|---|
| 4,987,955 | A * | 1/1991 | Bergqvist et al. | 165/167 |
| 5,435,383 | A | 7/1995 | Rajagopal | |
| 6,607,026 | B1 * | 8/2003 | Naji et al. | 165/153 |
| 2004/0112579 | A1 | 6/2004 | Strahle | |
| 2007/0261833 | A1 | 11/2007 | Yang et al. | |

FOREIGN PATENT DOCUMENTS

| | | | |
|---|---|---|---|
| EP | 1 850 082 | | 10/2007 |
| JP | 01-170881 | U | 12/1989 |
| JP | 07-229687 | | 8/1995 |
| JP | 08-511863 | | 12/1996 |
| JP | 11-351765 | | 12/1999 |
| JP | 2001-280888 | | 10/2001 |
| JP | 2002195776 | A | 7/2002 |
| JP | 03527704 | B2 | 5/2004 |
| JP | 2006-517648 | | 7/2006 |
| WO | WO 95/00810 | | 1/1995 |
| WO | WO 2004/072570 | | 8/2004 |

OTHER PUBLICATIONS

Form PCT/IB/326 Notification of Transmittal of Translation of the IPRP (Oct. 14, 2010).

(Continued)

*Primary Examiner* — Brandon M Rosati
(74) *Attorney, Agent, or Firm* — Buchanan Ingersoll & Rooney PC

(57) ABSTRACT

A plate heat exchanger including a plurality of heat exchanger plates (1), a first end plate and a second end plate. The plates are permanently joined to each other by means of a braze material. Each heat exchanger plate has a heat transfer area and a plurality of porthole areas surrounding a respective porthole. The plate heat exchanger including a plurality of having a bottom surface turned towards the heat exchanger plates. At least one of the flat elements including an annular protrusion extending from the bottom surface and tightly abutting one of the porthole areas of the outermost heat exchanger plate.

18 Claims, 8 Drawing Sheets

(56) References Cited

OTHER PUBLICATIONS

Form PCT/IB/373 International Preliminary Report on Patentability (IPRP) (Oct. 15, 2010).
Form PCT/ISA/237 Written Opinion of the International Searching Authority (Jan. 23, 2009).
European Search Report issued on Apr. 26, 2013 by European Patent Office in corresponding European Patent Application No. 08741886.
Japanese Office Action issued on Aug. 2, 2012 by Japan Patent Office in corresponding Japanese Patent Application No. 2011-502890, and English translation thereof.

* cited by examiner

PLATE HEAT EXCHANGER

THE FIELD OF THE INVENTION

The present invention refers to a plate heat exchanger.

JP-3527704 discloses such a plate heat exchanger comprising a plurality of heat exchanger plates which are provided beside each other. A first protective plate is provided beside a first outermost one of the heat exchanger plates and a first frame plate is provided outside the first protective plate. A second protective plate is provided beside the other second outermost heat exchanger plate and a second frame plate is provided outside the second protective plate. The plates are brazed to each other to form a plate package having first plate interspaces and second plate interspaces. Each heat exchanger plate has a heat exchanger area, a first porthole area, a second porthole area, a third porthole area and a fourth porthole area, each porthole area surrounding a respective porthole defined by a porthole edge. The plate heat exchanger comprises four connection pipes joined to a respective one of the porthole areas and each comprising an integral attachment flange. The attachment flanges are provided between the first frame plate and the first protective plate, between the first protective plate and the first outermost heat exchanger plate or between the frame plate and the first outermost heat exchanger plate.

In many heat exchanger applications, it is desirable to achieve a high, or a very high, design pressure, i.e. to be able to permit a high, or a very high, pressure of one or both of the media flowing through the plate interspaces. It is also desirable to be able to permit such high pressures in plate heat exchangers of the kind defined above having permanently joined heat exchanger plates, e.g. through brazing. Such high design pressures are difficult to achieve without the provision of external strengthening components.

A weak area in such plate heat exchangers is the porthole area, i.e. the area immediately around the portholes. These areas determine the design pressure in plate heat exchangers used today. However, although a certain design of the porthole area would improve the design pressure, this design would not improve the strength at another area of the plate heat exchanger, i.e. the problem would then merely be displaced.

One example of an application which requires very high design pressures is plate heat exchangers for evaporators and condensers in cooling circuits having carbon dioxide as a cooling agent. Carbon dioxide is in this context very advantageous from an environmental point of view in comparison with traditional cooling agents, such as freons.

SUMMARY OF THE INVENTION

The object of the present invention is to provide a plate heat exchanger having a high design pressure, and more precisely a plate heat exchanger permitting a very high pressure of at least one of the media flowing therethrough.

This object is achieved by the plate heat exchanger initially defined, which is characterised in that at least one of the flat elements comprises an annular protrusion extending from the bottom surface and tightly abutting one of the porthole areas of at least one of the outermost heat exchanger plates. Such a flat element will provide a strengthening of the porthole area. Thanks to the annular protrusion, the flat element will be tightly and securely attached to the heat exchanger plate in this area.

According to an embodiment of the invention, each heat exchanger plate extends along a main extension plane, wherein said areas extend between a primary level at a distance from the main extension plane and a secondary level at a distance from and on an opposite side of the main extension plane, wherein each of the porthole areas comprises an annular flat area located at one of the primary and secondary levels. Advantageously, the annular protrusion may then tightly abut the annular flat area at the secondary level.

According to a further embodiment of the invention, each of the porthole areas comprises a set of inner portions disposed on the annular flat area and distributed along the porthole edge, the inner portions being displaced from the annular flat area and extending to the other of the primary and secondary levels. Advantageously, the annular protrusion may then be located outside the inner portions seen from the respective porthole.

According to a further embodiment of the invention, each porthole area comprises a set of outer portions distributed along the annular flat area at a distance from the inner portions and being displaced from the annular flat area and extending to the other of the primary and secondary levels. Advantageously, the annular protrusion may then be located inside the outer portions seen from the respective porthole.

According to a further embodiment of the invention, the plate heat exchanger comprises a plurality of connection pipes joined to a respective porthole, wherein the flat element forms an annular attachment flange of a respective connection pipe. Such a flat element may be an integral part of the connection pipe. The flat element, as an annular attachment flange of the connection pipe, provides a tight and secure joining of the connection pipe to the respective porthole of the plate package.

According to a further embodiment of the invention, at least one of the flat elements is a separate part joined to the respective connection pipe. Such a solution is advantageous in case the connection pipe has any projecting parts, such as an external thread. The flat element may then be provided between the end plate and the outermost heat exchanger plate, whereafter the connection pipe is introduced into the porthole and joined to the flat element. Advantageously, the at least one of the flat elements may be joined to the respective connection pipe by means of brazing.

According to a further embodiment of the invention, the flat element covers a respective porthole. The flat element may then be joined to a porthole opposite to one of the connection pipes. In this case, the flat element functions as an element strengthening the porthole area when no connection pipe is joined there to. Further-more, the flat element will provide a secure sealing of the porthole area.

According to a further embodiment of the invention, the flat elements are brazed to at least one of the end plates and to at least one of the outermost heat exchanger plates.

According to a further embodiment of the invention, at least one of the end plates has a raised portion around each porthole to provide a space for the respective flat element.

According to a further embodiment of the invention, the porthole areas comprise a first porthole area, a second porthole area, a third porthole area and a forth porthole area.

BRIEF DESCRIPTION OF THE DRAWINGS

The present invention will now be explained more closely by means of a description of various embodiments and with reference to the drawings attached hereto.

DETAILED DESCRIPTION OF VARIOUS EMBODIMENTS OF THE INVENTION

Figure 1:
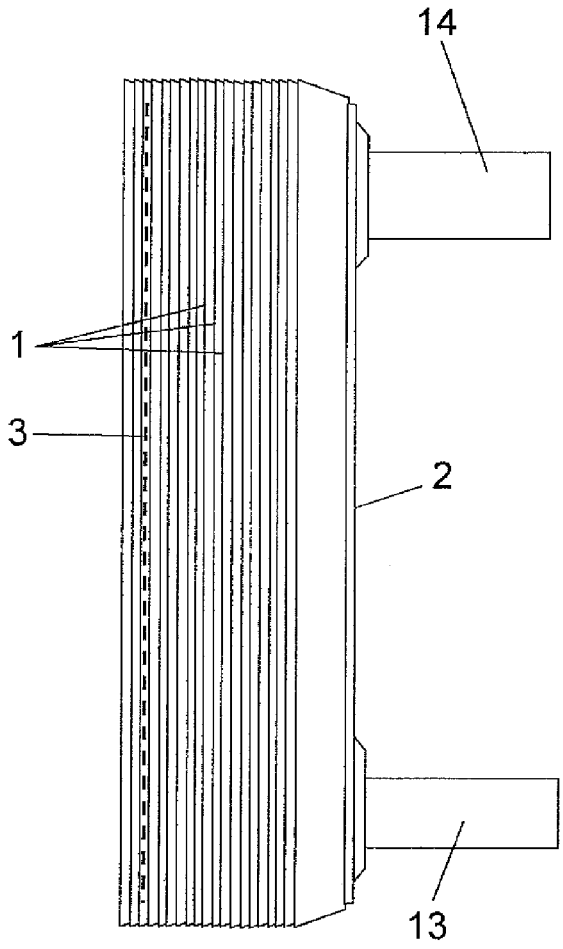
FIG. 1 shows a side view of a plate heat exchanger according to the invention.
Figure 2:
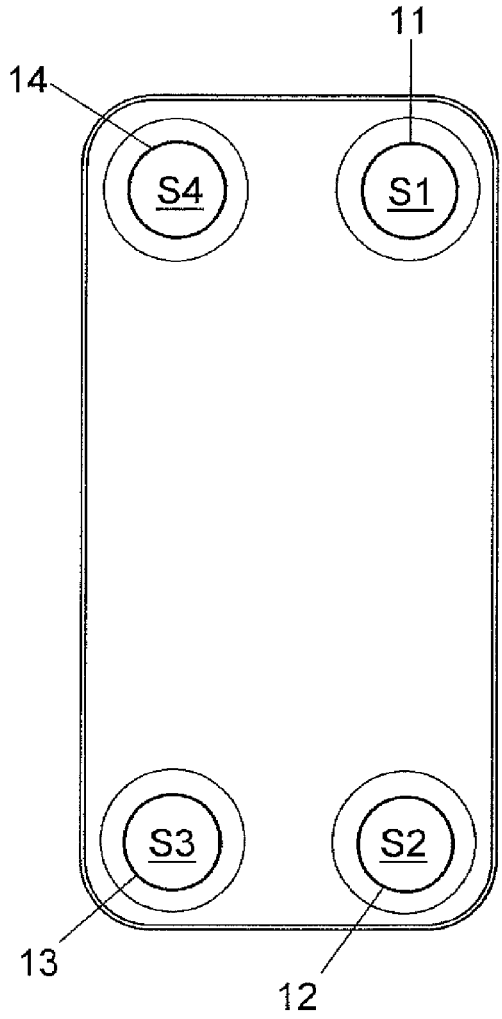
FIG. 2 shows a plan view of the plate heat exchanger in FIG. 1.

FIGS. 1 and 2 shows a plate heat exchanger comprising a plurality of heat exchanger plates 1, a first end plate 2, which is provided beside an outermost one of the heat exchanger plates 1, and a second end plate 3, which is provided beside the other opposite outermost heat exchanger plate 1.

The heat exchanger plates 1 are produced through forming of a metal sheet and provided beside each other. The first end plate 2, the second end plate 3 and the heat exchanger plates 1 are permanently joined to each other through brazing by means of a braze material to form a plate package. The plate package define or have first plate interspaces 4 for a first medium and second plate interspaces 5 for a second medium, see FIG. 6. The first and second medium may be any suitable heat transfer medium. For instance, the first and/or the second medium may be carbon dioxide.

The plate heat exchanger of the embodiments disclosed has four portholes S1, S2, S3 and S4, wherein the porthole S1 is connected to a connection pipe 11 and communicates with the first plate interspaces 4, the porthole S2 is connected to a connection pipe 12 and communicates with the first plate interspaces 4, the porthole S3 is connected to a connection pipe 13 and communicates with the second plate interspaces 5 and the porthole S4 is connected to a connection pipe 14 and communicates with the second plate interspaces 5. It is to be noted that the plate heat exchanger may have another number of portholes than those disclosed, e.g. 2, 3, 5, 6, 7 or 8 portholes. Connection pipes may be provided extending from the first end plate 2, as disclosed, and/or from the second end plate 3.

Figure 3:
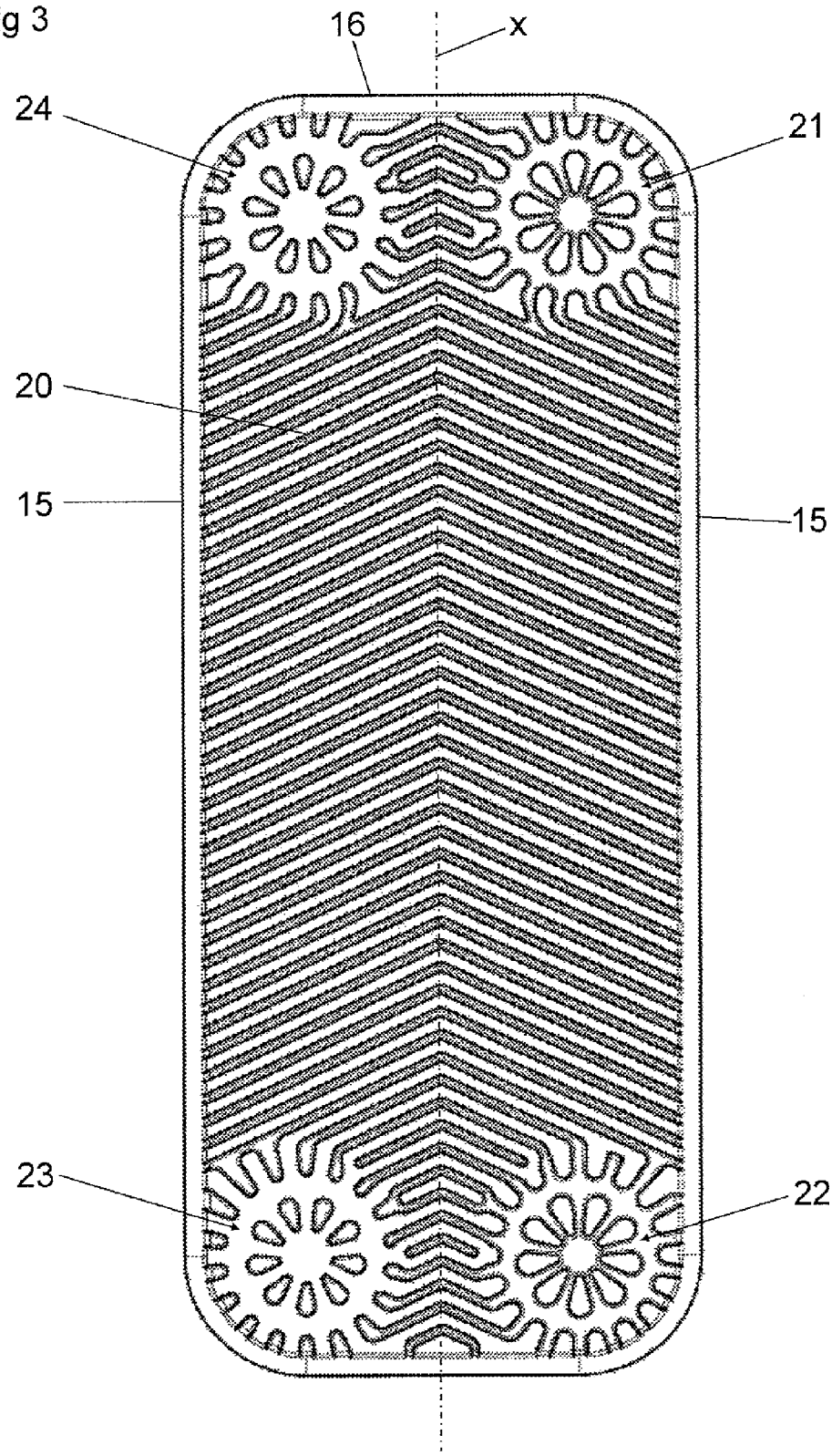
FIG. 3 shows a plan view of a heat exchanger plate of the plate heat exchanger in FIG. 1.

Each heat exchanger plate 1 has, in the embodiments disclosed, a rectangular shape with two long side edges 15 and two short side edges 16, see FIG. 3. A longitudinal centre axis x extends between and in parallel with the two long side edges 15 and transversely to the short side edges 16. Each heat exchanger plate 1 also extends along a main extension plane p, see FIG. 6.

Figure 4:
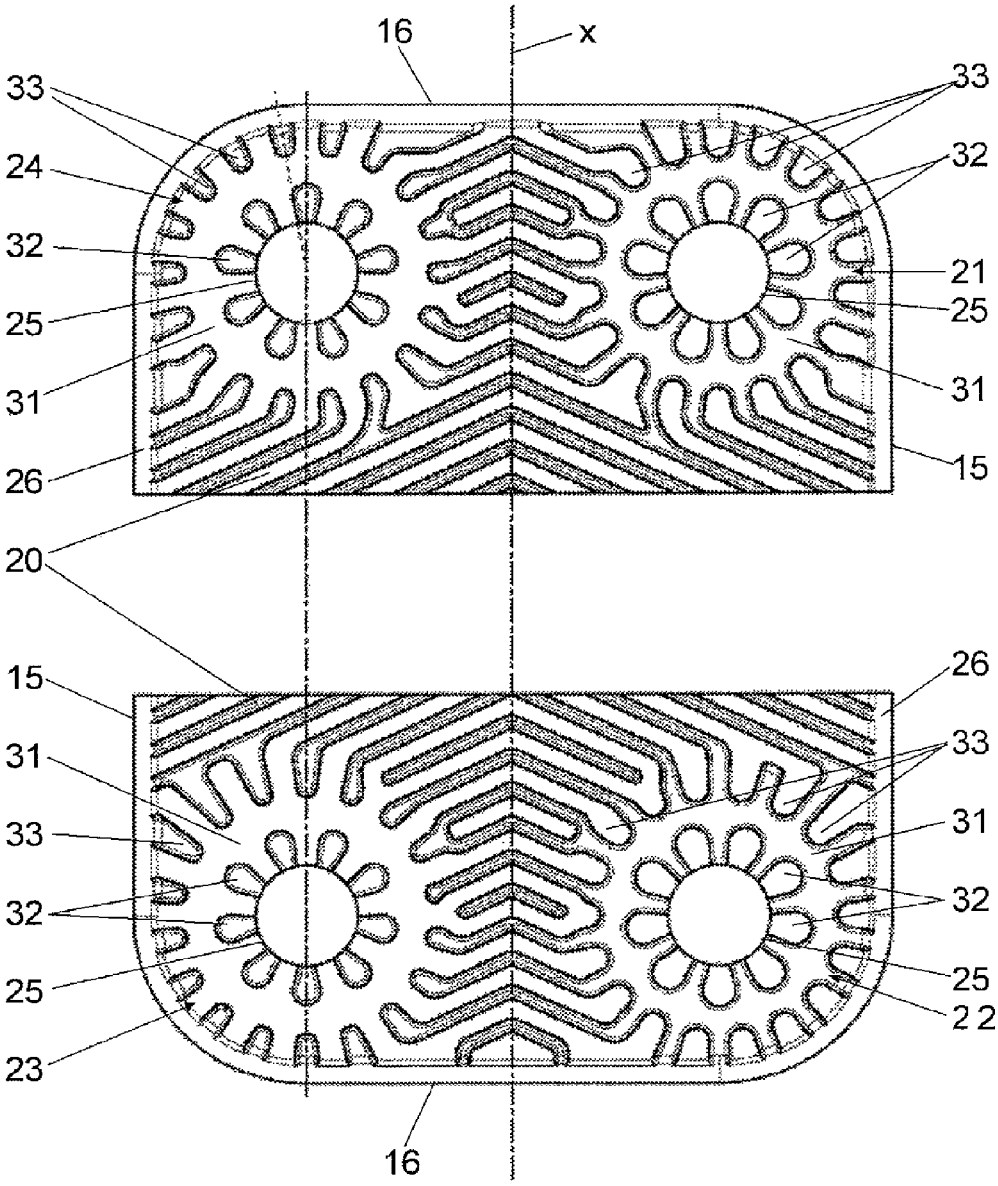
FIG. 4 shows another plan view of a heat exchanger plate of the plate heat exchanger in FIG. 1.

As can be seen from FIGS. 3 and 4, each heat exchanger plate 1 has a heat transfer area 20, at which the main part of the heat transfer between the first and second media take place, and a plurality of porthole areas 21-24. In the embodiments disclosed, the porthole areas 21-24 comprise a first porthole area 21, a second porthole area 22, a third porthole area 23 and a fourth porthole area 24. Each porthole area 21-24 surrounds a respective porthole through the heat exchanger plate 1. Each porthole is defined by a porthole edge 25.

Figure 6:
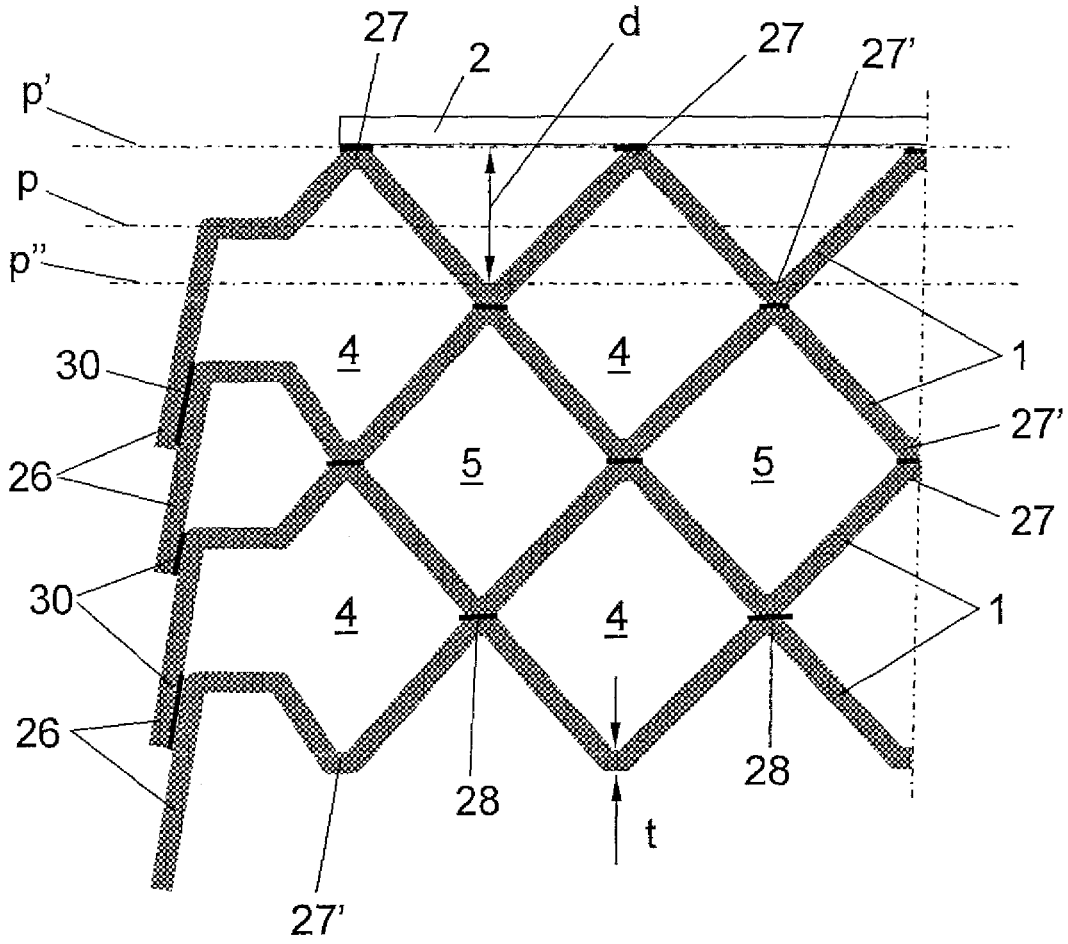
FIG. 6 shows a cross-sectional view through some of the heat exchanger plates at a heat transfer area of the plate heat exchanger in FIG. 1.

All of the areas 20-24 extend, on one side of the heat exchanger plate 1, between a primary level p' at a distance from the main extension plane p, and a secondary level p" at a distance from and on an opposite side of the main extension plane p, see FIG. 6. With respect to said one side of the heat exchanger plate 1, the primary level p' forms an upper level of the heat exchanger plate 1, and the secondary level p" forms a lower level of the heat exchanger plate 1 as seen in FIG. 6. The primary level p' is thus located more closely to the first end plate 2 than the secondary level p". Each heat exchanger plate 1 also has a flange 26 extending around the heat exchanger plate 1 along the long side edges 15 and the short side edges 16. As can be seen in FIG. 6, the flange 26 extends further away from the main extension plane p than the secondary level p".

Each heat exchanger plate 1 is made through forming of a metal sheet having a metal sheet thickness t. It is to be noted that the metal sheet thickness t may vary and be somewhat changed after the forming of the heat exchanger plate 1. The metal sheet thickness t, before the forming, may lie in the range $0.2 \leq t \leq 0.4$ mm. Advantageously, the metal sheet thickness t, before the forming, may be 0.3 mm or approximately 0.3 mm.

Each heat exchanger plate 1 also has a depth d, see FIG. 6. The depth d is defined by the distance between the primary level p' and the secondary level p". The depth d may be equal to or less than 1.0 mm, preferably equal to or less than 0.90 mm, more preferably equal to or less than 0.85 mm or most preferably equal to or less than 0.80 mm.

Figure 7:
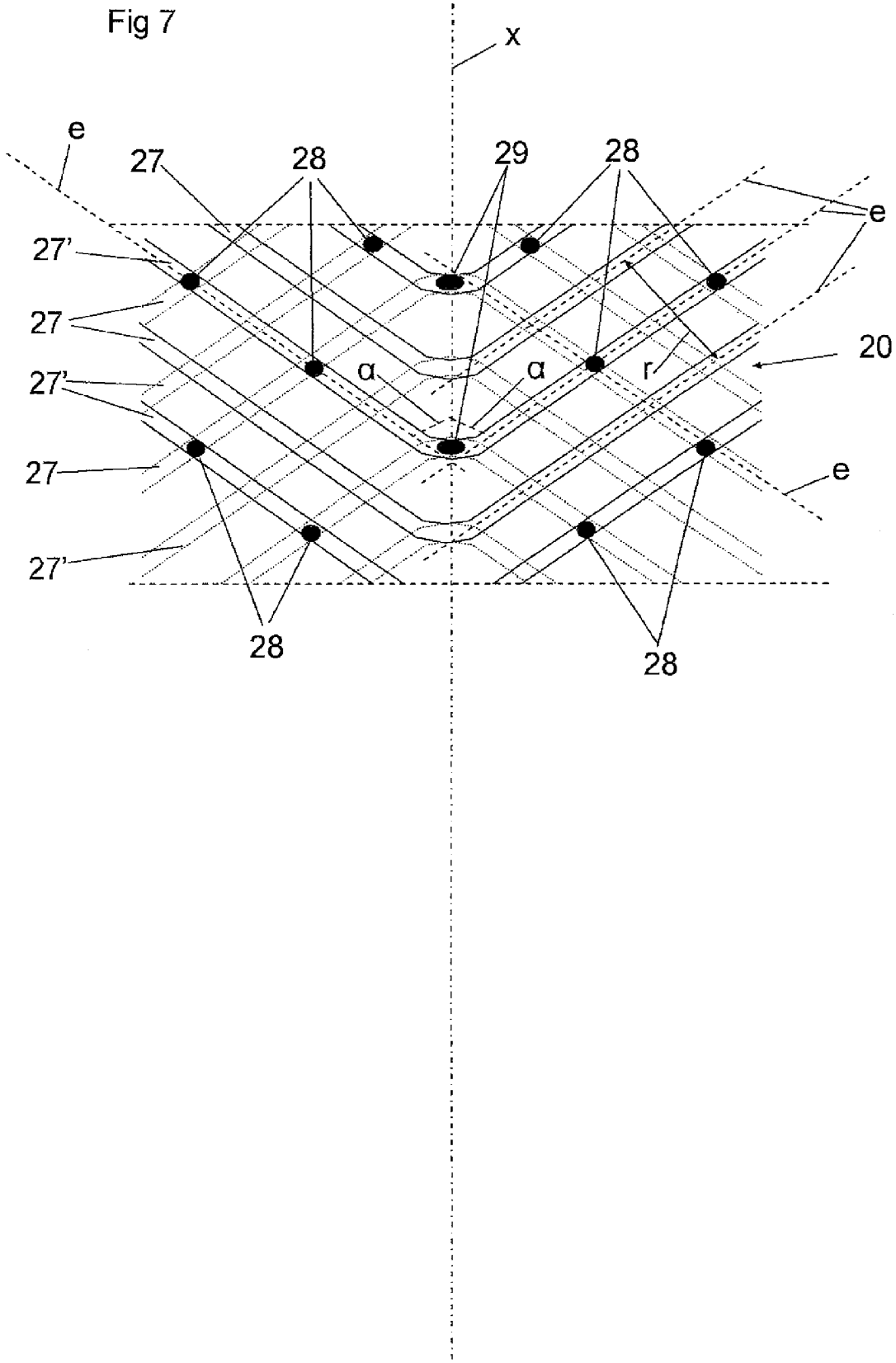
FIG. 7 shows a plan view of a part of the heat transfer area of a heat exchanger of the plate heat exchanger in FIG. 1.

As can be seen in FIGS. 3, 6 and 7, the heat transfer area 20 comprises a corrugation of ridges 27 and valleys 27' arranged in such a manner that the ridges 27 of one of the heat exchanger plates 1 abut the valleys 27' of an adjoining one of the heat exchanger plates 1 to form a plurality of joining areas 28 between a heat exchanger plate 1, indicated with full lines in FIG. 7, and an adjacent heat exchanger plate 1, indicated with dotted lines in FIG. 7. The ridges 27 are disposed at a distance r form each other, and extend in parallel with each other and with the valleys 27'.

The ridges 27 and valleys 27' extend along an extension line e forming an angle $\alpha$ of inclination with the centre line x, see FIG. 7. The angle $\alpha$ of inclination may lie in the range $20° \leq \alpha \leq 70°$. Advantageously, the angle $\alpha$ of inclination may be 45°, or approximately 45°. In the embodiments disclosed, the extension line e of each ridge 27 and valley 27' forms a positive angle $\alpha$ of inclination at one side of the centre line x and a corresponding negative angle $\alpha$ of inclination at the other side of the centre line x. As can be seen in FIG. 7, the ridges 27 and valleys 27' also form joining areas 29 at the centre line x. Furthermore, joining areas 30 are formed between the flanges 26 of adjacent heat exchanger plates 1. The distance r between adjacent ridges 27, or between a respective central extension line e of adjacent ridges 27, may be less than 4 mm, or may be approximately 3 mm, or 3 mm, see FIG. 7.

As mentioned above the plate heat exchanger is brazed by means of a braze material introduced between the heat exchanger plates 1 before the brazing operation. The braze material has a braze volume with respect to the heat transfer area 20 of the plate heat exchanger. The first interspaces 4 and the second interspaces 5 of the plate heat exchanger have an interspace volume with respect to the heat transfer area 20 of the plate heat exchanger. In order to obtain a high strength of the plate heat exchanger, it is advantageous to provide a sufficiently large quantity of braze material forming the above-mentioned joining areas 28, 29 between adjacent heat exchanger plates 1. Consequently, the proportion of the braze volume to the interspace volume may be at least 0.05, at least 0.06, at least 0.08 or at least 0.1.

Each porthole area 21-24 comprises an annular flat area 31, a set of inner portions 32 disposed on the annular flat area 31 and distributed along the porthole edge 25. The inner portions 32 are displaced from the annular flat area 31 in a normal direction with respect to the main extension plane p. Each porthole area 21-24 also comprises a set of outer portions 33 disposed on and distributed along the annular flat area 31 at a distance from the inner portions 32. The inner portions 32, which adjoin the porthole edge 25, extend to or are located at the same level as the outer portions 33, whereas the annular flat area 31 is located at another level than the inner portions 32 and the outer portions 33. More specifically, the inner portions 32 and the outer portions 33 of the first porthole area 21 and the second porthole area 22 extend to or are located at the secondary level p", whereas the annular flat area 31 of the first porthole area 21 and the second porthole area 22 is located at the primary level p'. Furthermore, the inner portions 32 and the outer portions 33 of the third porthole area 23 and the fourth porthole area 24 extend to or are located at the primary level p', whereas the annular flat area 31 of the third porthole area 23 and the fourth porthole area 24 is located at the secondary level p". Each inner portion 32 have a flat extension at the respective level p' and p", and each outer portion 33 have a flat extension at the respective level p' and p". This means that the flat extension of the inner portions 32 and the outer portions 33 of the first and second porthole areas 21, 22 is located at the secondary level p", whereas the flat extension of the inner portions 32 and the outer portions 33 of the third porthole area 23 and the fourth porthole area 24 is located at the primary level p'.

In the plate package, every second heat exchanger plate 1 is rotated 180° in the main extension plane p. This means that the inner portions 32 of one heat exchanger plate 1 will adjoin and be joined to a respective one of the inner portions 32 of an adjacent heat exchanger plate 1. In the same way, the outer portions 33 of one heat exchanger plate 1 will adjoin and be joined to a respective one of the outer portions 33 of an adjacent heat exchanger plate 1. More specifically, the inner portions 32 and the outer portions 33 of the first porthole area 21 of one heat exchanger plate 1 will be joined to a respective one of the inner portions 32 and the outer portions 33 of the third porthole area 23 of an adjacent heat exchanger plate in the plate package. In the same way, the inner portions 32 and the outer portions 33 of the second porthole area 22 of one heat exchanger plate 1 will be joined a respective one of the inner portions 32 and the outer portions 33 of the fourth porthole area 24 of an adjacent heat exchanger plate 1 in the plate package of the embodiment disclosed.

Figure 5:
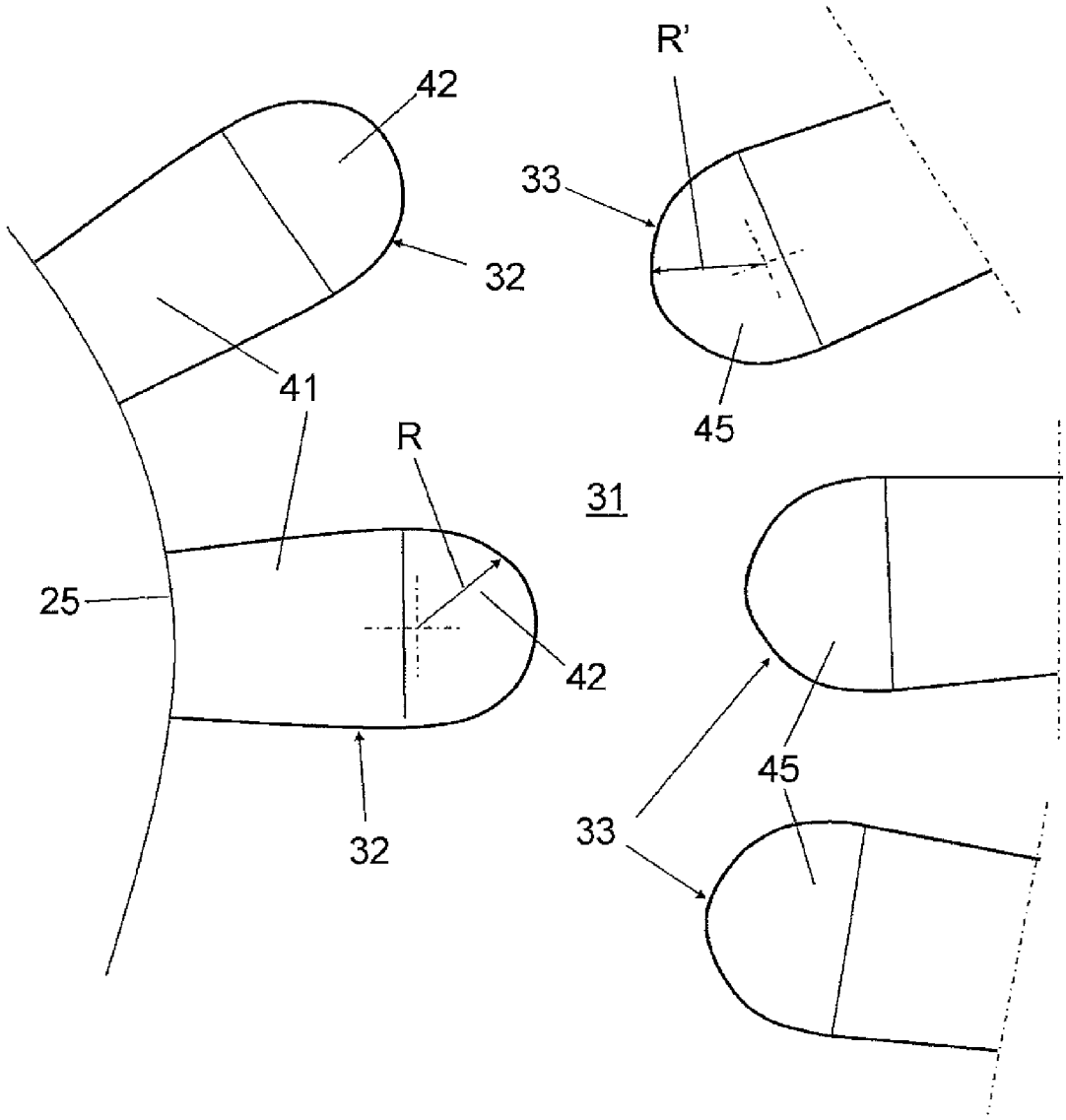
FIG. 5 shows a plan view of a part of a porthole area of the heat exchanger plate in FIG. 4.

As can be seen in FIG. 5, each inner portion 32 has an inner part 41 extending to and adjoining the porthole edge 25. Moreover, each inner portion 32 has an outer segment 42 adjoining the inner part 41 and having an angular extension of at least 180°. The outer segment 42 adjoins the annular flat portion 31. The outer segment 42 has a continuous contour and a radius R. The radius R is substantially constant and allowed to vary within the range of 0.8 R≤R≤1.2 R, more specifically within the range 0.9 R≤R≤1.1 R, and most specifically within the range of 0.95 R≤R≤1.05 R.

Furthermore, each of the outer portions 33 may have an inner segment 45 adjoining the annular flat area 31 and having an angular extension of at least 90°, at least 120°, or at least 150°. The inner segment 45 preferably also has a continuous contour, and may have a radius R', which is constant or substantially constant, and allowed to vary within a range 0.8 R'≤R'≤1.2 R', more specifically within the range 0.9 R≤R≤1.1R, and most specifically within the range of 0.95 R≤R≤1.05 R.

As can be seen in FIG. 4, both the inner portions 32 and the outer portions 33 of each porthole area 21-24 are uniformly distributed around the respective porthole. More specifically, the inner portions 32 present an equal inner angular distance between adjacent inner portions 32. The outer portions 33 present an equal outer angular distance between adjacent outer portions 33. Furthermore, the outer portions 33 of the first porthole area 21 and the third porthole area 23 have a first relative peripheral position with respect to the inner portions 32 of these two porthole areas 21 and 23. The outer portions 33 of the second porthole area 22 and the fourth porthole area 24 have a second relative peripheral position with respect of the inner portions 32 of these two porthole areas 22 and 24. It can be seen from FIG. 4 that the first relative peripheral position is displaced peripherally, or includes a peripheral displacement, in relation to the second relative peripheral position. The peripheral displacement is, in the embodiments disclosed, equal to half, or approximately half, the equal outer angular distance between the adjacent outer portions 33.

In the embodiment disclosed, each porthole area 21-24 comprises 9 inner portions 32 and 18 outer portions 33. This is a suitable number of inner portions 32 and outer portions 33. In the embodiments disclosed, the inner angular distance is about twice the outer angular distance. It is to be noted however, that the number of inner portions 32 and the number of outer portions 33 can vary and deviate from the numbers disclosed.

Figure 8:
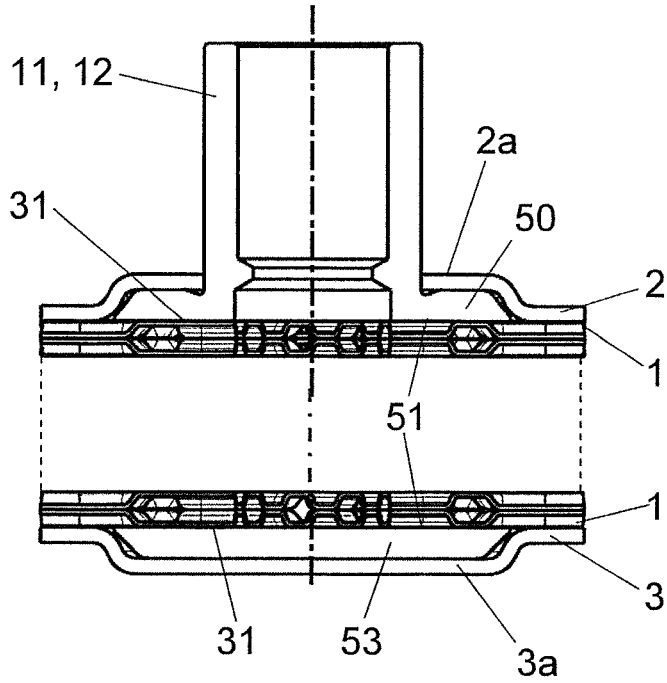
FIG. 8 shows a sectional view through a part of the porthole S1 of the plate heat exchanger in FIG. 1.
Figure 9:
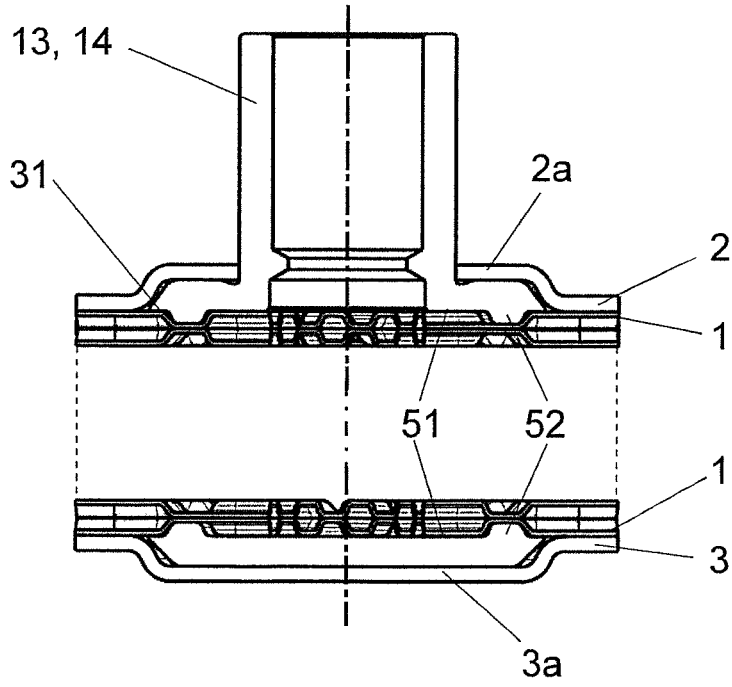
FIG. 9 shows a sectional view through a part of the porthole S3 of the plate heat exchanger in FIG. 1.

Each of the four connection pipes 11-14 is joined to a respective one of the porthole areas 21-24 and comprises a flat element 50. Each flat element 50 forms an attachment flange attached to or integral with a respective connection pipe 11-14 and joined to the plate package, see FIGS. 8 and 9. All of the flat elements 50 are provided between one of the end plates 2, 3 and one of the outermost heat exchanger plates 1. More specifically, in the embodiments disclosed, each flat element 50 is provided between one of the outermost heat exchanger plates 1 and the first end plate 2. The flat elements 50 are brazed to the outermost heat exchanger plate 1 and the first end plate 2. The area around each porthole of the first end plate 2 is raised at a raised portion 2*a* to provide a space for the respective flat element 50 as can be seen in FIGS. 1, 8 and 9. With respect to the first and second porthole S1 and S2, the flat element 50 has a flat, or a substantially flat, bottom surface 51 abutting and joined to the annular flat area 31 of the outermost heat exchanger plate 1 at the first porthole area 21 and the second porthole area 22, respectively. The annular flat area 31 is thus located at the primary level p', see FIG. 8.

With respect to the third and fourth portholes S3, S4, each flat element 50 comprises an annular protrusion 52 projecting from the flat bottom surface 51 and turned towards the plate package. The annular protrusion 52 tightly abuts the annular flat area 31 of the outermost heat exchanger plate 1 at the third porthole area 23 and the fourth porthole area 24, respectively. The annular flat area 31 is thus located at the secondary level p", see FIG. 9. Consequently, a secure and tight abutment of the flat elements 50 is ensured for all of the portholes S1-S4.

Between the second end plate 3 and the other outermost heat exchanger plate 1, there is provided a flat element 53 forming a strengthening washer 53. The flat elements 53 do not form a part of a connection pipe 11-14 and cover the respective porthole. The flat element 53 for the portholes S1 and S2 has a flat, or substantially flat, bottom surface 51 tightly abutting and joined to the annular flat area 31 of the other outermost heat exchanger plate 1 in the same way as the flat element 50. The flat element 53 for the portholes S3 and S4 has a flat bottom surface 51 with an annular protrusion 52 tightly abutting and joined to the annular flat area of the other outermost heat exchanger plate 1. Also the second end plate 3 has a raised portion 3*a* around each porthole.

It is to be noted that one or more of the flat elements 53 may be replaced by a respective connection pipe having a flat element 50 in case an inlet and/or an outlet is to be provided as an alternative or supplement through the second end plate 3.

Figure 10:
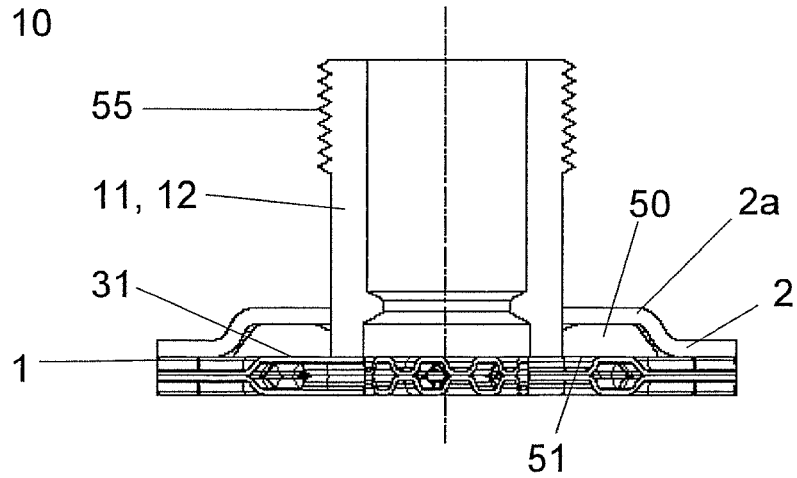
FIG. 10 shows a sectional view similar to the one in FIG. 8 of another embodiment.
Figure 11:
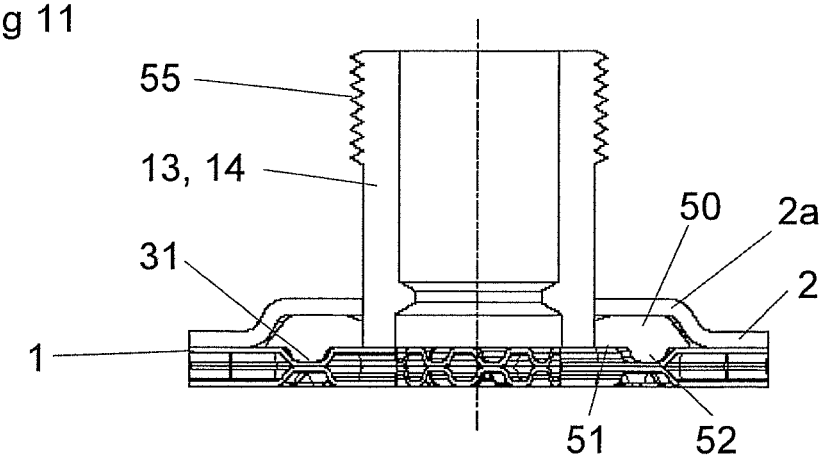
FIG. 11 shows a sectional view similar to the one in FIG. 9 of the other embodiment.

FIGS. 10 and 11 disclose a further embodiment which differs from the embodiment disclosed in FIGS. 8 and 9 merely in that the connection pipe 11-15 comprises an external thread 55 and that the flat element 50 is brazed to the connection pipe 11-15. In such a way, the flat element 50 can be disposed between the outermost heat exchanger plate 1 and the first end plate 2. The connection pipe 11-15 may thereafter be introduced into the respective porthole to be brazed to the flat element 50 in connection with the brazing of the plate heat exchanger.

The present invention is not limited to the embodiments disclosed but may be varied and modified within the scope of the following claims.

The invention claimed is:

1. A plate heat exchanger comprising a plurality of heat exchanger plates, which are formed from a metal sheet and are provided beside each other, a first end plate provided beside an outermost one of the heat exchanger plates and a second end plate beside another outermost heat exchanger plate, wherein the end plates and the heat exchanger plates are permanently joined to each other by a braze material to form a plate package having first plate interspaces and second plate interspaces, wherein each heat exchanger plate has a pattern forming a heat transfer area and a plurality of porthole areas, each porthole area surrounding a respective porthole defined by a porthole edge, wherein the plate heat exchanger comprises a plurality of flat elements joined to the plate package and having a bottom surface turned towards the plate package, and wherein at least one of the flat elements comprises: (i) a hole possessing an inner surface; and (ii) an annular protrusion extending from the bottom surface and tightly abutting one of the porthole areas of at least one of the outermost heat exchanger plates, the annular protrusion possessing an inner surface offset from the inner surface of the hole.

2. A plate heat exchanger according to claim 1, wherein each heat exchanger plate extends along a main extension plane, wherein said heat transfer area and said porthole areas extend between a primary level at a distance from the main extension plane and a secondary level at a distance from and on an opposite side of the main extension plane, and wherein each of the porthole areas comprises an annular flat area located at one of the primary and secondary levels.

3. A plate heat exchanger according to claim 2, wherein the annular protrusion tightly abuts the annular flat area at the secondary level.

4. A plate heat exchanger according to claim 3 wherein each of the porthole areas comprises a set of inner portions disposed on the annular flat area and distributed along the porthole edge, the inner portions being displaced from the annular flat area and extending to the other of the primary and secondary levels.

5. A plate heat exchanger according to claim 4, wherein the annular protrusion is located outside the inner portions seen from the respective porthole.

6. A plate heat exchanger according to any one of claims 4 and 5, wherein each porthole area comprises a set of outer portions distributed along the annular flat area at a distance from the inner portions and being displaced from the annular flat area and extending to the other of the primary and secondary levels.

7. A plate heat exchanger according to claim 6, wherein the annular protrusion is located inside the outer portions seen from the respective porthole.

8. A plate heat exchanger according to claim 1, wherein the plate heat exchanger comprises a plurality of connection pipes each joined to a respective porthole and wherein the respective flat element forms an annular attachment flange of the respective connection pipe.

9. A plate heat exchanger according to claim 8, wherein at least one of the flat elements is a separate part joined to the respective connection pipe.

10. A plate heat exchanger according to claim 9, wherein the at least one of the flat elements is joined to the respective connection pipe by brazing.

11. A plate heat exchanger according to claim 1, wherein each flat element covers a respective porthole.

12. A plate heat exchanger according to any one of claims 8 to 11, wherein each flat element is joined to a porthole opposite to one of the connection pipes.

13. A plate heat exchanger according to claim 1, wherein the flat elements are brazed to at least one of the end plates and to at least one of the outermost heat exchanger plates.

14. A plate heat exchanger according to claim 1, wherein at least one of the end plates has a raised portion around each porthole to provide a space for the respective flat element.

15. A plate heat exchanger according to claim 1, wherein the porthole areas comprise a first porthole area a second porthole area a third porthole area and a fourth porthole area.

16. A plate heat exchanger comprising:

a plurality of heat exchanger plates arranged adjacent one another along an axial direction and permanently joined to each other to form a plate package including first plate interspaces and second plate interspaces;

each heat exchanger plate including a plurality of portholes extending through the heat exchanger plate and a pattern forming a heat transfer area;

the plate package being bounded on opposite sides by a first one of the heat exchanger plates and a second one of the heat exchanger plates;

a first end plate permanently joined to an outwardly facing surface of the first heat exchanger plate, and a second end plate permanently joined to an outwardly facing surface of the second heat exchanger plate;

a first annular recess formed in the outwardly facing surface of the first heat exchanger plate and surrounding one of the portholes extending through the first heat exchanger plate;

a second annular recess formed in the outwardly facing surface of the second heat exchanger plate and surrounding one of the portholes extending through the second heat exchanger plate;

a first flange abutting against the outwardly facing surface of the first heat exchanger plate, the first flange including a first annular protrusion extending from the first flange in the axial direction and being received by the first annular recess formed in the outwardly facing surface of the first heat exchanger plate; a first hole extending through the first flange and possessing an inner surface, the first annular protrusion possessing an inner surface offset from the inner surface of the first hole;

a second flange abutting against the outwardly facing surface of the second heat exchanger plate, the second flange including a second annular protrusion extending from the second flange in the axial direction and being received by the second annular recess formed in the outwardly facing surface of the second heat exchanger plate; and a second hole extending through the second flange and possessing an inner surface, the second annular protrusion possessing an inner surface offset from the inner surface of the second hole.

17. The plate heat exchanger of claim 16, further comprising a first connection pipe axially aligned with one of the portholes of the first heat exchanger plate and being integrally formed with the first flange.

18. The plate heat exchanger of claim 1, wherein the porthole area of the at least one outermost heat exchanger plate abutting the annular protrusion includes an annular recess configured to receive the annular protrusion of the at least one flat element.

* * * * *